United States Patent [19]

Sanchez Torres

[11] 4,177,090

[45] Dec. 4, 1979

[54] MUFFLER MADE OF MANGANESE ALLOY

[76] Inventor: Silvestre Sanchez Torres, 30 Poniente No. 1512, Interior 2, Puebla, Pue, Mexico

[21] Appl. No.: 967,941

[22] Filed: Dec. 11, 1978

Related U.S. Application Data

[60] Division of Ser. No. 891,258, Mar. 29, 1978, Pat. No. 4,147,527, which is a continuation-in-part of Ser. No. 699,599, Jun. 24, 1976, abandoned.

[51] Int. Cl.[2] ..... C22C 22/00

[52] U.S. Cl. ..... 148/32

[58] Field of Search ..... 148/32; 75/134 M; 181/212, 294

[56] References Cited

U.S. PATENT DOCUMENTS

| | | | |
|---|---|---|---|
| 3,133,347 | 5/1964 | Cape | 75/134 M |
| 3,725,053 | 4/1973 | Masumoto et al. | 75/134 M |

*Primary Examiner*—Arthur J. Steiner

*Attorney, Agent, or Firm*—Edward E. Dyson; John J. Byrne

[57] ABSTRACT

This invention relates to a new rust-resistant alloy for use at high temperatures, especially in mufflers in automotive vehicles.

2 Claims, No Drawings

MUFFLER MADE OF MANGANESE ALLOY

BACKGROUND AND FIELD OF THE INVENTION

This application is a Division of U.S. Ser. No. 891,258, filed Mar. 29, 1978 and now U.S. Pat. No. 4,147,527, which in turn is a continuation-in-part of application U.S. Ser. No. 699,599, filed June 24, 1976 now abandoned, entitled NEW COMPOSITION OF MATERIAL FOR A RUST-RESISTANT STEEL FOR USE AT HIGH TEMPERATURES.

This invention relates to an alloy having utility in fabricating automotive vehicle mufflers and more particularly mufflers which are also catalytic converters.

Catalytic converters are employed to reduce detrimental automobile engine emissions. Such emissions are caused, among other reasons, by insufficient burning, by soft burning, or by poor carburation, i.e., any factor that causes incomplete combustion. In effect, gasoline is not always completely burned and, therefore, the exhaust gases contain carbon monoxide, unburned hydrogen or hydrocarbons, and nitrogen oxides and nitric oxides.

The new composition of matter of this invention is a new rust-resistant alloy used preferably for the manufacture of catalytic converters for transforming polluting gases into nonpolluting gases.

The new composition comprises manganese alloyed with about 1.0%–about 2.0% silicon
about 0.9%–about 1.9% copper
about 0.5%–about 0.12% carbon
about 0.5%–about 0.9% iron
about 0.2%–about 2.3% titanium
about 15.0%–about 22.0% chromium
about 2.5%–about 4.0% molybdenum
about 5.0%–about 10.0% aluminum
about 0.1%–about 0.3% selenium said manganese being present in amount less than about 70.0%.

The alloy may be hardened by precipitation or cold rolling; generally has a tension resistance of about 8750 to 12,980 Kgs./cm$^2$ and a hardness of about 180 to about 240 Brinell with an elongation of about 24% to about 53%, with an upper limit of 46% preferred.

Preferably the composition comprises:

1.6% silicion
1.6% copper
0.11% carbon 0.7% iron
0.3% titanium
19.0% chromium
3.1% molybdenum
8.9% aluminum
0.25% selenium
the remainder being manganese.

The foregoing percentages are expressed on a weight percent basis.

The alloy generally with an elongation of 23% to 45% is preferably used in 1.37 mm and 1.21 mm gauges. The alloy may be quenched soft, preferably No. 6 Quench, or hard, preferably No. 1 Quench.

3.1% of (Mo) Molybdenum is used to increase resistance to hot chemical products with a small quantity of (Se) Selenium to improve machining. Alloys with high content of (Cr) chrome are used for strong chemical resistance to high temperatures. These will permit working with mixed chemical compounds and hot gases.

In accordance with this invention a new rust-resistant alloy is obtained with a long service life at the high temperatures and operating conditions found in automobile mufflers.

In general manner, while there has been disclosed an effective and efficient embodiment of the invention, it should be well understood that the invention is not limited to such embodiment as there might be changes made in the arrangement, disposition, and form of the parts without departing from the principal of the present invention as comprehended within the scope of the accompanying claims.

What is claimed is:

1. A muffler having as a sheet metal component thereof a quenched rust-resistant alloy for high temperature use consisting essentially of:

1.0%–2.0% silicon
0.9%–1.9% copper
0.5%–0.12% carbon
0.5%–0.9% iron
0.2%–2.3% titanium
15.0%–22.0% chromium
2.5%–4.0% molybdenum
5.0%–10.0% aluminum
0.1%–0.3% selenium and the balance manganese being present in amount less than about 70.0%.

2. The muffler of claim 1 wherein the sheet metal has a gauge of 1.37 mm. or 1.21 mm.

* * * * *